US008792812B2

(12) United States Patent
Fujioka

(10) Patent No.: US 8,792,812 B2
(45) Date of Patent: Jul. 29, 2014

(54) IMAGE FORMING DEVICE EQUIPPED WITH OBLIQUE MOTION PREVENTION MECHANISM

(75) Inventor: Michio Fujioka, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 209 days.

(21) Appl. No.: 13/428,092

(22) Filed: Mar. 23, 2012

(65) Prior Publication Data

US 2013/0084110 A1 Apr. 4, 2013

(30) Foreign Application Priority Data

Sep. 30, 2011 (JP) ..... 2011-217293

(51) Int. Cl.
*G03G 15/16* (2006.01)

(52) U.S. Cl.
USPC ..... 399/312; 399/165; 474/122

(58) Field of Classification Search
USPC ..... 399/162, 165, 302, 303, 312, 313, 329; 474/109, 119, 122; 198/840
See application file for complete search history.

(56) References Cited

U.S. PATENT DOCUMENTS

| | | | | |
|---|---|---|---|---|
| 4,641,770 | A * | 2/1987 | Hediger | 226/23 |
| 7,623,816 | B2 * | 11/2009 | Maki et al. | 399/312 |
| 7,810,633 | B2 * | 10/2010 | Okamoto et al. | 198/806 |
| 7,986,903 | B2 * | 7/2011 | Park | 399/121 |
| 8,447,218 | B2 * | 5/2013 | Yamana | 399/329 |
| 2009/0202275 | A1 | 8/2009 | Nishida et al. | |

FOREIGN PATENT DOCUMENTS

| | | |
|---|---|---|
| JP | 05-027622 | 2/1993 |
| JP | 11-344906 | 12/1999 |
| JP | 2000-130523 | 5/2000 |
| JP | 2009-190812 | 8/2009 |

* cited by examiner

*Primary Examiner* — Robert Beatty
(74) *Attorney, Agent, or Firm* — Banner & Witcoff, Ltd.

(57) ABSTRACT

An image forming device, comprising: an image formation unit; an endless belt; first, second and third rollers arranged in parallel such that the belt extends therebetween; a collar that is provided at least at one of ends in an axial direction of the first roller and moves in the axial direction when the belt moves obliquely; a press arm that presses an one axial end side of the second roller on which the collar is provided; and an oblique motion force conversion unit that includes a cam on which an slanting surface is formed and a movable part slidably contacting the slanting surface, and that converts a force for moving the collar into a pressing force for pressing the press arm, and wherein the slanting surface becomes closer to a rotation center of the first roller at a point further from the belt.

18 Claims, 9 Drawing Sheets

IMAGE FORMING DEVICE EQUIPPED WITH OBLIQUE MOTION PREVENTION MECHANISM

CROSS-REFERENCE TO RELATED APPLICATION

This application claims priority under 35 U.S.C. §119 from Japanese Patent Application No. 2011-217293, filed on Sep. 30, 2011. The entire subject matter of the application is incorporated herein by reference.

BACKGROUND

1. Technical Field

Aspects of the present invention relate to an image forming device having an endless belt.

2. Related Art

Image forming devices having an endless belt are widely used. For example, an image forming device is configured such that an inclination of a steering roll is electrically controlled so as to suppress oblique motion or meandering of a belt. The term "oblique motion or meandering" means a phenomenon where the belt moves in the width direction while rotating. Hereafter, the "oblique motion or meandering" is named generally and simply as "oblique motion". Incidentally, the width direction of the belt is equal to an axial direction of each of rollers between which the belt extends.

SUMMARY

However, in the above described conventional image forming device, an electric sensor, such as an edge sensor or a displacement sensor, and an electric actuator, such as a driving unit, are required to electrically control the inclination of the steering roll.

Aspects of the present invention are advantageous in that they provide an image forming device capable of preventing oblique motion of a belt through mechanical control.

According to an aspect of the invention, there is provided an image forming device, comprising: an image formation unit; an endless belt; first, second and third rollers arranged such that axial directions of the first, second and third rollers are substantially parallel with each other, and the endless belt extends between the first, second and third rollers; a collar that is provided at least at one of ends in an axial direction of the first roller and moves in the axial direction while being pressed by the endless belt when the endless belt moves obliquely; a press arm that is formed to extend from a first roller side to a second roller side and presses an one axial end side of the second roller on which the collar is provided, by being pressed by the collar when the collar moves; and an oblique motion force conversion unit that includes a cam on which an slanting surface slanted with respect to the axial direction is formed and a movable part which slidably contacts the slanting surface, and that converts a force for moving the collar into a pressing force for pressing the press arm by changing a direction of the force for moving the collar. In this configuration, the slanting surface is slanted such that the slanting surface becomes closer to a rotation center line of the first roller at a point further from an end of the belt in a width direction.

BRIEF DESCRIPTION OF THE ACCOMPANYING DRAWINGS

DETAILED DESCRIPTION

Hereafter, embodiments according to the invention will be described with reference to the accompanying drawings. In the embodiments described below, the present invention is applied to a tandem type laser printer.

First Embodiment

1. Overall Configuration of Image Forming Device

Figure 1:
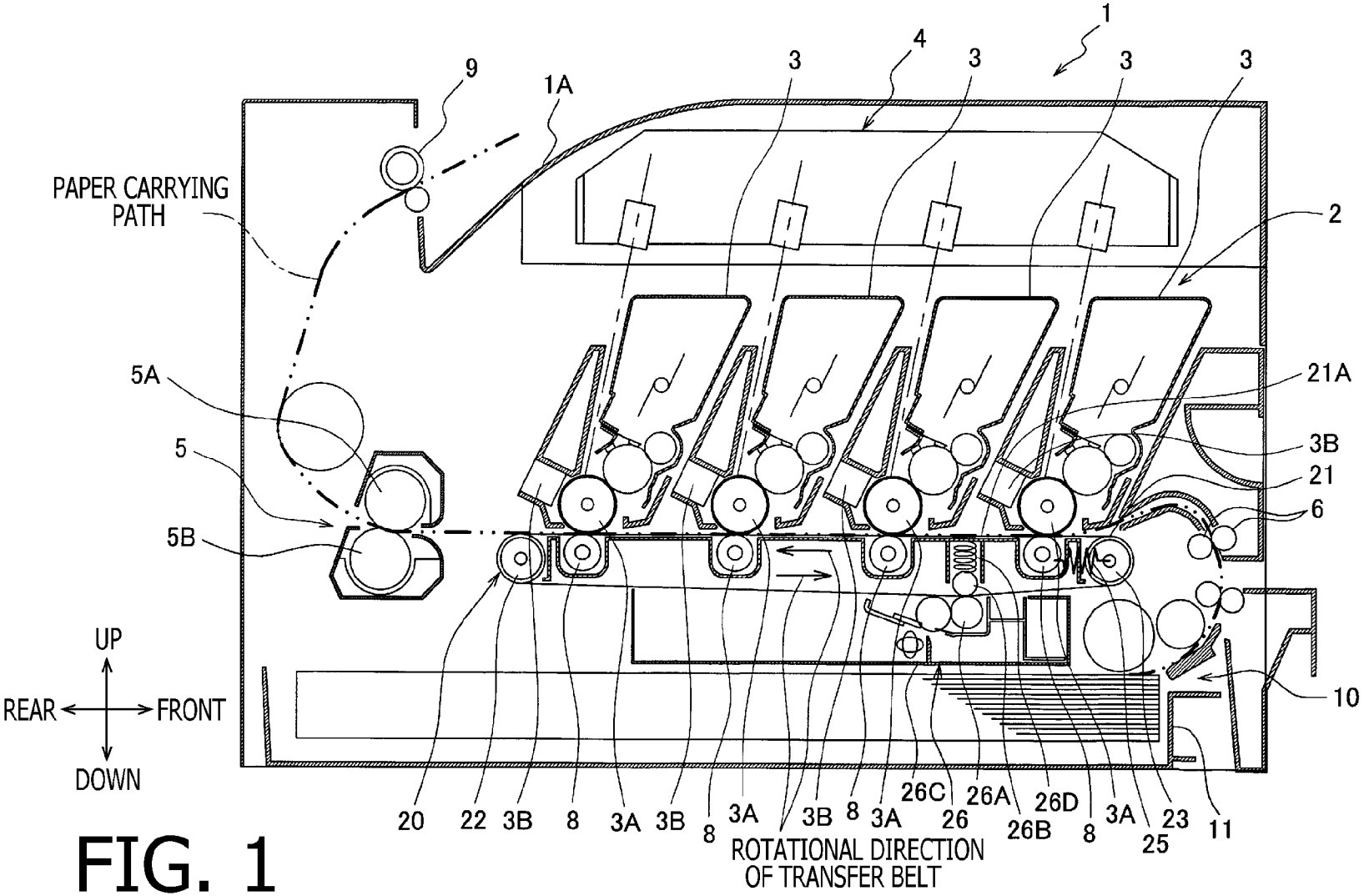
FIG. 1 is a central cross section of an image forming device according to an embodiment.

As shown in FIG. 1, in an image forming device 1, various components including an image formation unit 2 and a paper supply unit 10 are accommodated. The image formation unit 2 forms an image (i.e., prints an image) on a sheet-like medium. The paper supply unit 10 sends out the sheet-like medium placed on a paper supply tray 11 to the image formation unit 2.

The components including the image formation unit 2 and the paper supply unit 10 are attached to a main body. The main body means a portion, such as a casing or a frame, which is not disassembled or removed by a user during a normal use state.

The image formation unit 2 is an electrophotographic type image formation unit including one or more process cartridges 3, one or more exposure units 4 and one fixing unit 5. Since the image formation unit 2 according to the embodiment is a color system, the process cartridges 3 are provided respectively for a plurality of colors of developers including black, yellow, magenta and cyan.

Each process cartridge 3 has various components including a photosensitive drum 3A on which a developer is held and a charger 3B which charges the photosensitive drum 3A. When the charged photosensitive drum 3A is exposed by the exposure unit 4, an electrostatic latent image is formed on an outer circumferential surface of the photosensitive drum 3A. Thereafter, when the charged developer is supplied to the photosensitive drum 3A, a developer image is held on the outer circumferential surface of the photosensitive drum 3A.

A transfer belt 21 functions as a carrying unit which carries the sheet-like medium supplied from the paper supply tray 11 to each of the photosensitive drums 3A. The photosensitive drums 3A are aligned in series in a rotational direction of the transfer belt 21 in a state where each photosensitive drum 3A faces a stretched surface 21A of the transfer belt 21 which is provided to extend between a drive roller 22 and a driven roller 23.

At positions opposite to the photosensitive drums 3A with respect to the transfer belt 21, transfer rollers 8 are arranged. The transfer roller 8 transfers the developer image held on the photosensitive drum 3A to the sheet-like medium being carried by the transfer belt 21. Therefore, according to the embodiment, the developer images of the respective colors held on the respective photosensitive drums 3A are superimposed directly on the sheet-like medium.

The sheet-like medium sent toward the image formation unit 2 from the paper supply tray 11 by the paper supply unit 10 is carried to a pair of registration rollers 6. The pair of registration rollers 6 straightens the position of the sheet-like medium, and then causes the sheet-like medium to rush into the image formation unit 2 at a predetermined timing.

The fixing unit 5 includes a heat roller 5A which heats the sheet-like medium while contacting the sheet-like medium, and a pressure roller 5B which presses the sheet-like medium against the heat roller 5A. The sheet-like medium ejected from the fixing unit 5 is ejected, by an ejection roller 9, to an ejection tray 1A provided on a top surface of the main body.

2. Configuration of Belt Unit

The transfer belt 21, the drive roller 22 and the driven roller 23 form a belt unit 20. The belt unit 20 according to the embodiment is detachably attachable to the main body.

That is, the transfer belt 21 is an endless belt made of resin, such as thermoplastic elastomer. The transfer belt 21 is provided to extend between the drive roller 22 and the driven roller 23 which are arranged such that axes thereof become parallel with each other. The drive roller 22 gives a rotational force to the transfer belt 21. The driven roller 23 rotates in accordance with rotation of the transfer belt 21.

Figure 2:
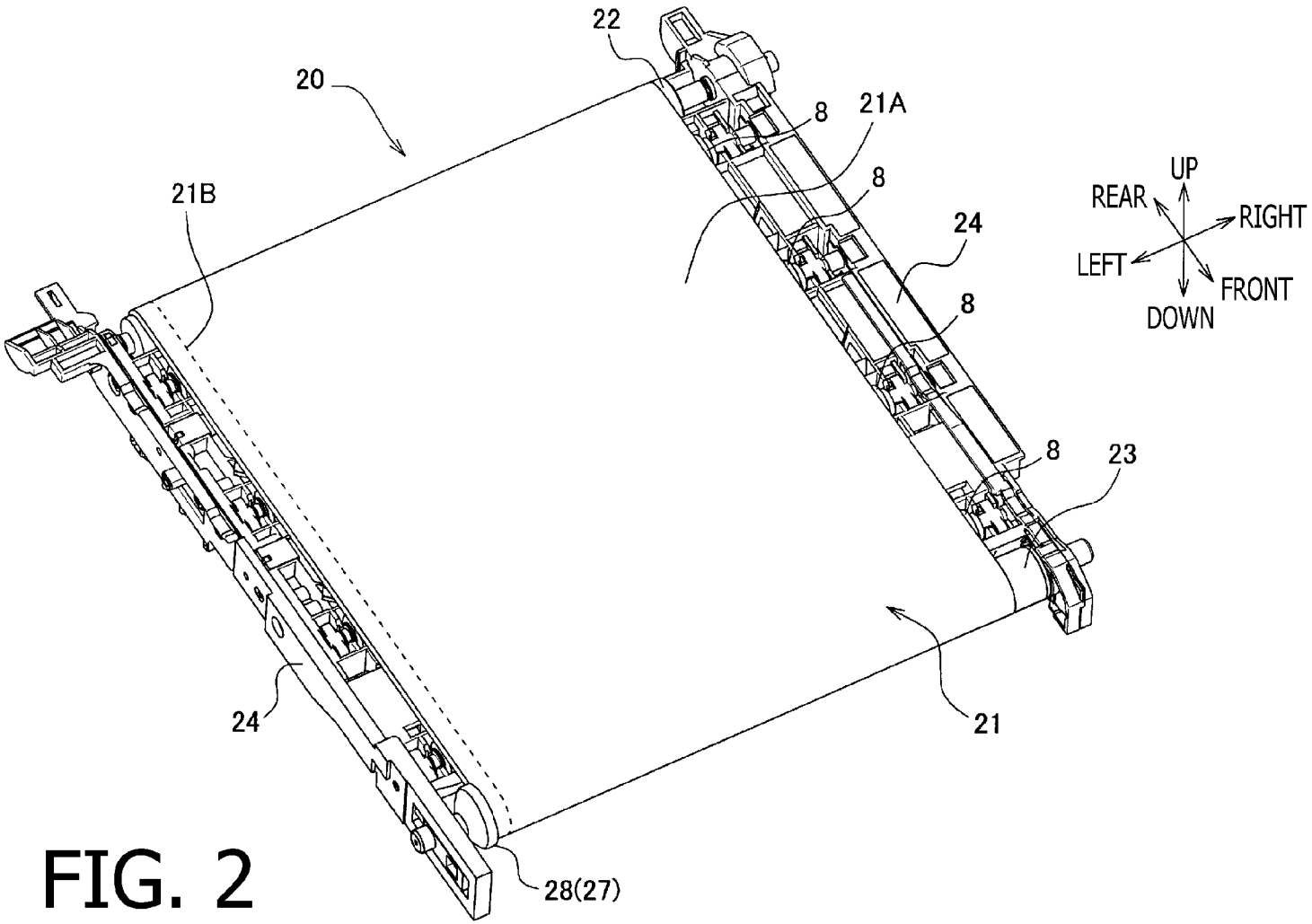
FIG. 2 is a perspective view of a belt unit of the image forming device according to a first embodiment.

As shown in FIG. 2, both ends of the drive roller 22 and the driven roller 23 are held on a frame 24. The drive roller 22 is stationary with respect to the frame 24, and the driven roller 23 is provided to be able to move in a stretching direction with respect to the frame 24. The term "stretching direction" means a direction parallel with a tension caused on the stretched surface 21A. Specifically, the stretching direction is a direction pointing from the drive roller 22 to the driven roller 23.

Incidentally, as shown in FIG. 1, the driven roller 23 receives an elastic force having a direction departing from the drive roller 23, from an elastic member 25 such as a spring. That is, the elastic member 25 functions as a means for generating a tension on the stretched surface 21A. The driven roller 23 functions as a tension roller which produces a tension on the transfer belt 21.

Figure 3:
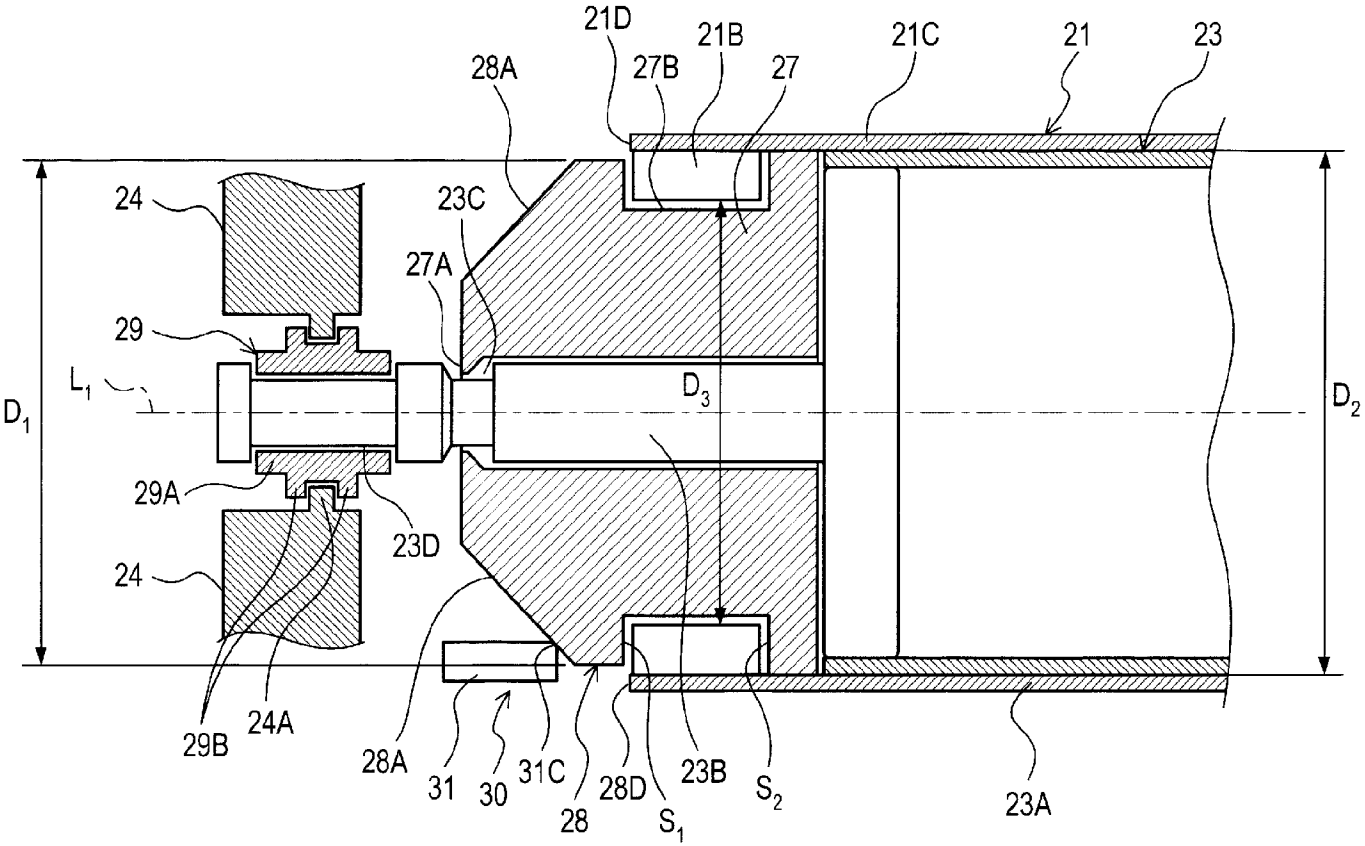
FIG. 3 is an enlarged cross section around a collar of the image forming device according to the first embodiment.

As shown in FIG. 3, on an inner surface of the transfer belt 21, a guide rib 21B is provided to protrude inward from the transfer belt 21 and to extend along the rotational direction of the transfer belt 21. In this embodiment, as shown in FIG. 2, the guide rib 21B is provided on one side in the width direction of the transfer belt 21. The width direction of the transfer belt 21 means a direction parallel with an axial direction of the drive roller 22.

The guide rib 21B according to the embodiment is formed integrally with the transfer belt 21 with an adhesion or a vulcanized adhesion.

On the opposite side of the process cartridge 3 with respect to the belt unit 20, i.e., under the belt unit 20, a cleaner unit 26 which removes the adhered substances, such as a developer, adhered to the outer circumferential surface of the transfer belt 21 is arranged as shown in FIG. 1. The cleaner unit 26 according to the embodiment is detachably attached to the main body.

The cleaner unit 26 includes a cleaning roller 26A and a cleaner box 26C. The cleaning roller 26A is configured to remove and recover the adhered substances from the surface of the transfer belt 21. The cleaner box 26C is a box for storing the removed and recovered adhered substances by the cleaning roller 26A.

On the opposite side of the cleaning roller 26A with respect to the transfer belt 21, a backup roller 26B which presses the transfer belt 21 against the cleaning roller 26A is arranged. The backup roller 26B is attached to the frame 24 to be able to move in a direction intersecting with the stretched surface 21A, and is pressed by an elastic member 26D, such as a spring, against the cleaning roller 26A side.

The backup roller 26B is also attached to the frame 24 to be substantially parallel with the axial direction of the driver roller 22 and the driven roller 23. Therefore, the transfer belt 21 is in a state of extending between the drive roller 22, the driven roller 23 and the backup roller 26B.

As shown in FIG. 3, the driven roller 23 includes a cylindrical roller part 23A which contacts an inner circumferential surface of the transfer belt 21, and a roller shaft 23B which covers the both ends in the axial direction of the roller part 23A and rotatably supports the roller part 23A.

At an end in the axial direction of the driven roller 23 on the side where the guide rib 21B is provided, a collar 27 having a cam part 28 on which a tapered slanting surface 28A is formed is provided.

In this embodiment, the cam part 28 and the collar 27 are made of resin having an excellent wear resistance property, such as POM. In the following, the term collar 27 is used to include the cam part 28, unless otherwise noted.

The collar 27 is rotatably attached to the roller shaft 23B in a state where movement of the collar 27 with respect to the roller shaft 23*b* in the axial direction is restricted. Therefore, the collar 27 is able to rotate independently from the roller shaft 23B without moving in the axial direction with respect to the roller shaft 23B.

Incidentally, movement of the collar 27 in the axial direction is restricted by fitting a projection 27A for engagement provided on the collar 27 to a groove 23C for engagement provided in the roller shaft 23B.

On the roller part 23A side with respect to the slanting surface 28A of the collar 27, a groove 27B to which the guide rib 21B fits is provided. Incidentally, the cam part 28 according to the embodiment is a part of the collar 27 on the slanting surface 28A side with respect to a left side wall S1 (see FIG. 3) which is one of a pair of side walls S1 and S2 of the guide groove 27B situated on the slanting surface 28A side.

The cam part 28 is formed such that the outer diameter D1 is smaller than the diameter D2 of the roller part 23A and larger than the inner diameter D3 of the guide rib 21B. As a result, a belt body 21C is prevented from contacting the left side wall S1. The belt body 21C is a thin film part of the transfer belt 21.

The roller shaft 23B is rotatably attached to the frame 24 via a bearing 29. The bearing 29 includes a cylindrical part 29A which slidably contacts the roller shaft 23B, and a pair of flange parts 29B.

The cylindrical part 29A is fitted into a sliding groove 23D provided on the outer circumferential surface of the roller shaft 23B. With this configuration, since the inner surface of the cylindrical part 29A slidably contacts the circular bottom surface of the sliding groove 23D, the roller shaft 23B is able to rotate. On the other hand, since both end faces in the axial direction of the cylindrical part 29A contact side walls of the sliding groove 23D, a large degree of movement of the roller shaft 23B in the axial direction with respect to the cylindrical part 29A is restricted.

The pair of flange parts 29B are formed as projections protruding outward from the outer circumferential surface of the cylindrical part 29A. A projection 24A formed to protrude from the frame 24 to the roller shaft 23B is sandwiched by the flange parts 29B. As a result, it becomes possible to restrict a large degree of movement of the bearing 29 in the axial direction with respect to the frame 24.

3. Configuration of Oblique Motion Force Conversion Unit

An oblique motion force conversion unit 30 is a mechanism for converting an oblique motion force acting on the collar 27 into a pressing force for pressing a press arm 31.

That is, when the transfer belt 21 moves obliquely to the collar 27 side, the side face of the guide rib 21B contacts the side wall S1. Therefore, the collar 27 is pressed by the transfer belt 21 and moves to the frame 24 side. In the following, the force for pressing the collar 27, i.e., the force for moving the collar 27 in the axial direction is referred to as an oblique motion force.

Figure 4:
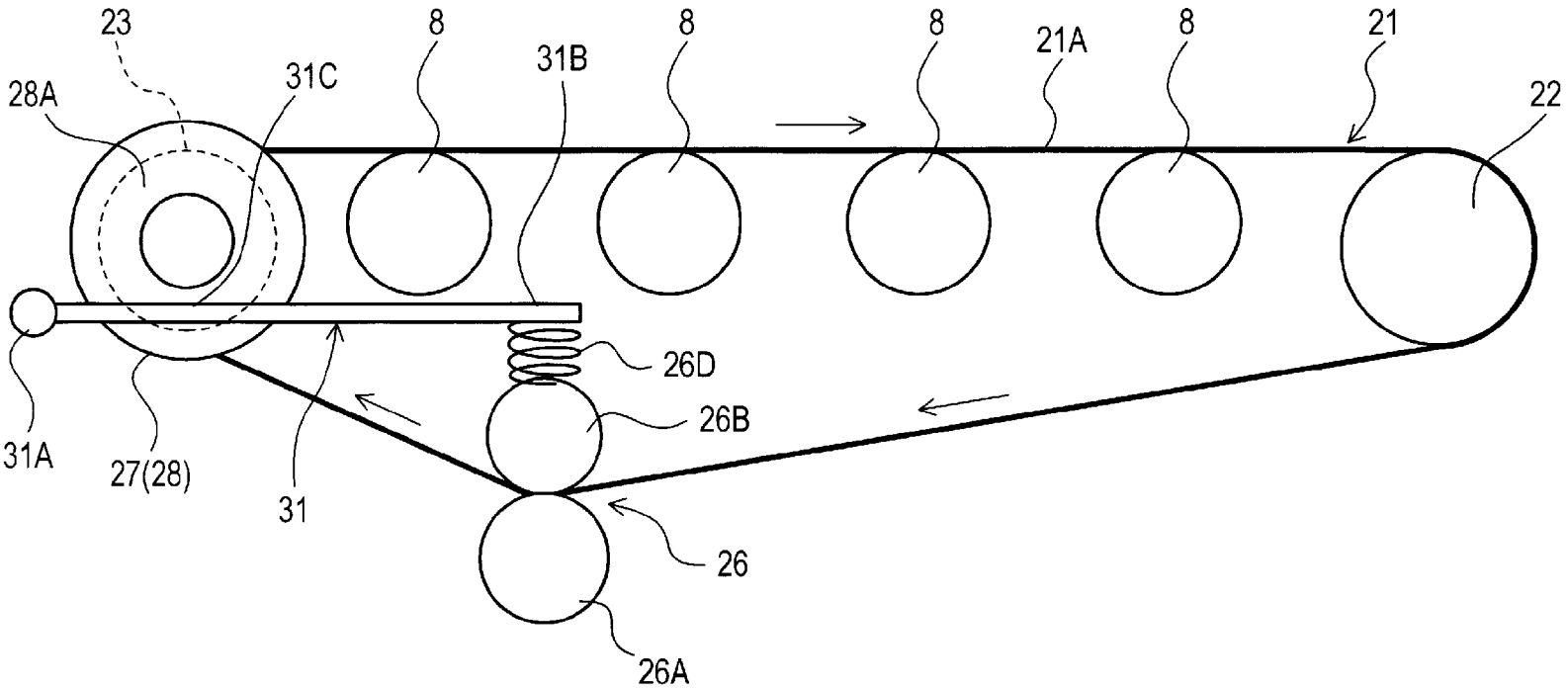
FIG. 4 is a side view of a belt unit of the image forming device according to the first embodiment.

As shown in FIG. 4, the press arm 31 is formed to extend from the driven roller 23 side to the backup roller 26B side. A swinging center 31A is defined on the driven roller 23 side of the press arm 31. On the other hand, an acting part 31B for pressing the backup roller 26B is defined on the backup roller 26B side of the press arm 31.

Between the swinging center 31A and the acting part 31B of the press arm 31, a movable part 31C is defined to slidably contact the slanting surface 28A. Therefore, in this embodiment, the size defined from the swinging center 31A to the acting part 31B is larger than the size defined from the swinging center 31A to the movable part 31C.

Figure 5:
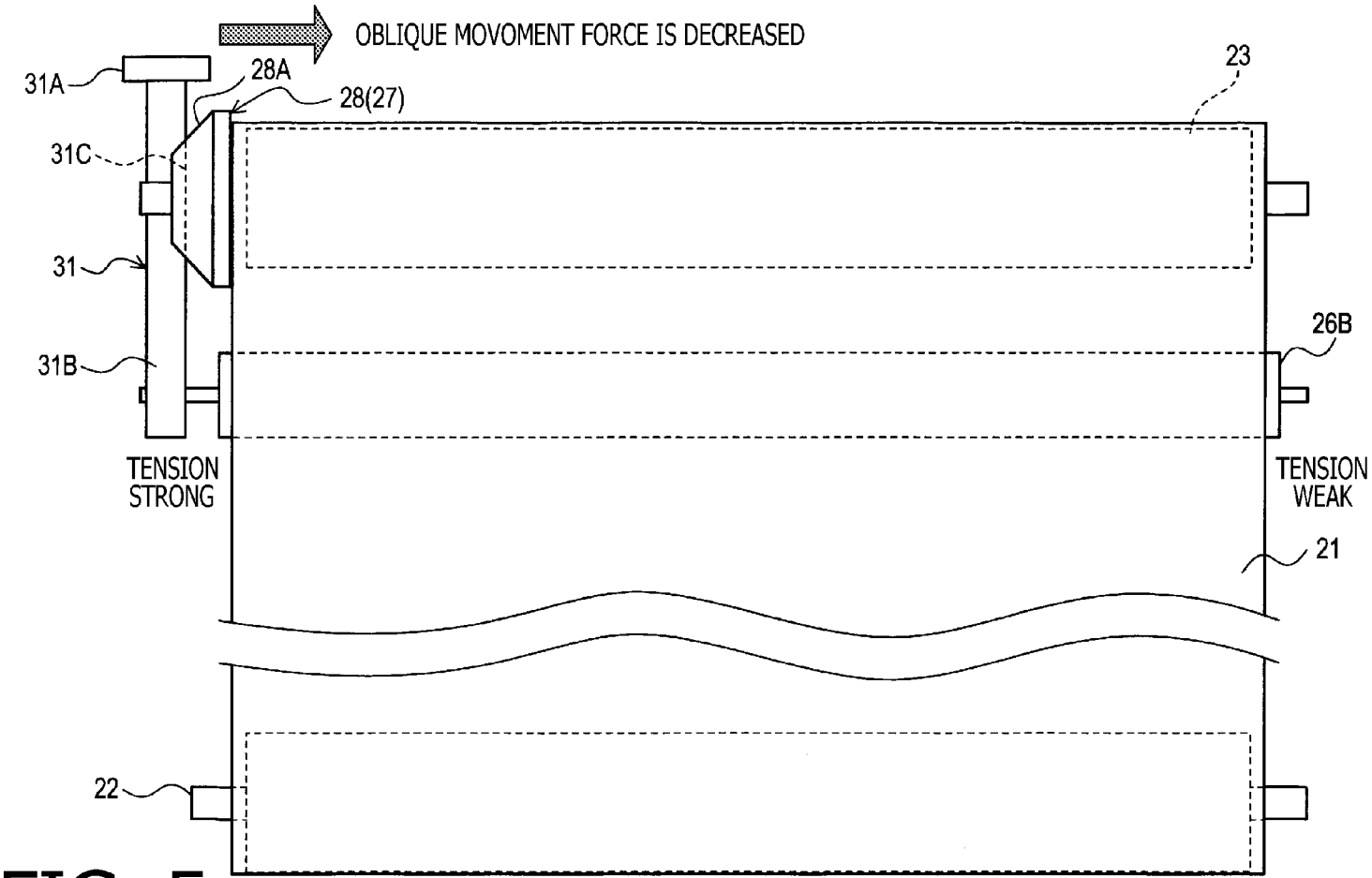
FIG. 5 is a top view of the belt unit of the image forming device according to the first embodiment.

As shown in FIG. 5, the press arm 31 extends in a direction perpendicular to the axial direction, and presses an axial end of the backup roller 26B on the side on which the color 27 is provided. As shown in FIG. 4, in this embodiment, the press arm 31 indirectly presses the backup roller 26B via the elastic member 26D.

As shown in FIG. 3, the slanting surface 28A is formed to be tapered in a conical shape to become closer to the rotation center line L1 of the driven roller 23 at a point further from an end 21D in the width direction of the transfer belt 21. As a result, when the collar 27 moves to the frame 24 side, the movable part 31C moves in a direction departing from the rotation center line L1 while slidably contacting the slanting surface 28A (see FIG. 6C).

That is, the direction of the force for moving the collar 27 in the axial direction, i.e., the oblique motion force, is changed by the slanting surface 28A and the movable part 31C, and is converted into a force for pressing the press arm 31. Therefore, when the transfer belt 21 obliquely moves and thereby the collar 27 moves to the frame 24 side, the press arm 31 swings in the direction pressing the backup roller 26B. Incidentally, the direction of the force pressing the backup roller 26B is a direction parallel with a direction intersecting with the axial direction and the longitudinal direction of the press arm 31.

When the press arm 31 swings in the direction departing from the rotation center line L1 and thereby presses the backup roller 26B, the acting part 31B receives a force pointing to the rotation center line L1 as a counteraction. Therefore, when the collar 27 moves in a direction departing from the frame 24, the press arm 31 swings and returns in the direction moving to the rotation center line L1.

4. Feature of Image Forming Device according to the Embodiment

Figure 6B:
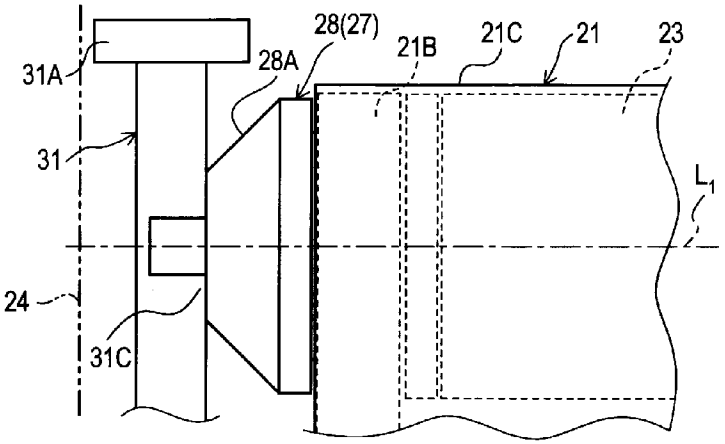
FIGS. 6B and 6D are enlarged top side cross sections around the collar of the image forming device according to the first embodiment.
Figure 6D:
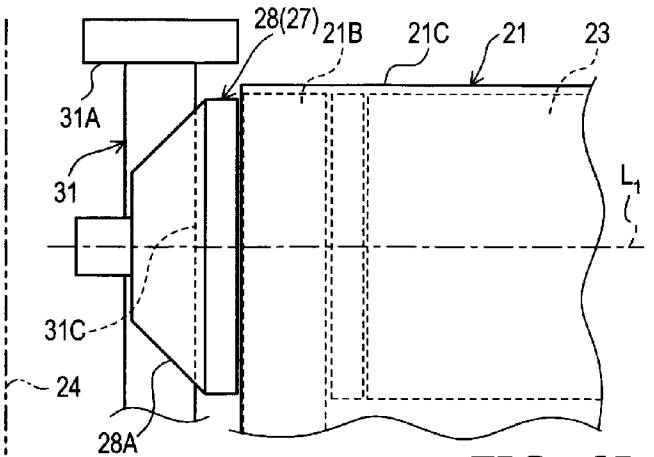
Figure 6A:
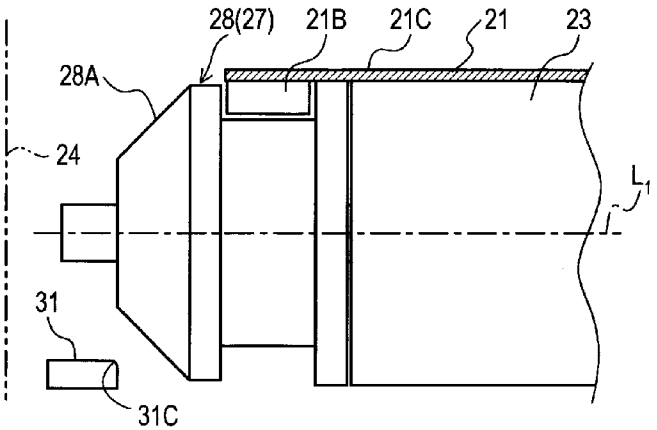
FIGS. 6A and 6C are enlarged side cross sections around the collar of the image forming device according to the first embodiment.
Figure 6C:
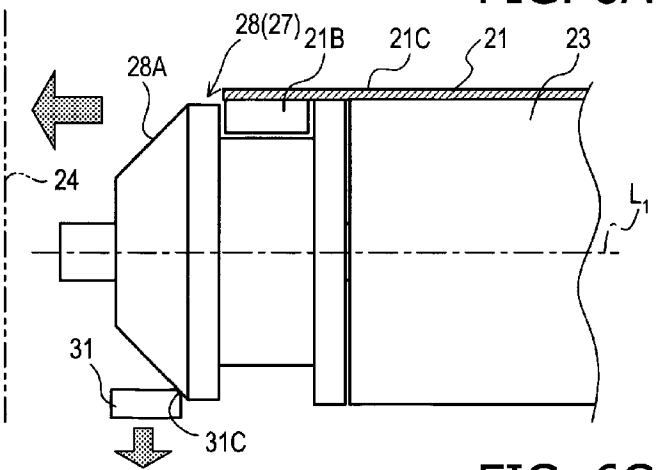

In this embodiment, as shown in FIG. 6D, when the transfer belt 21 obliquely moves to the collar 27 side, the collar 27 moves to the frame 24 side by being pressed by the transfer belt 21. Therefore, as shown in FIG. 6C, the movable part 31C slides and moves in the direction departing from the rotation center line L1 and concurrently the press arm 31 swings in the direction departing from the rotation center line L1.

Figure 7:
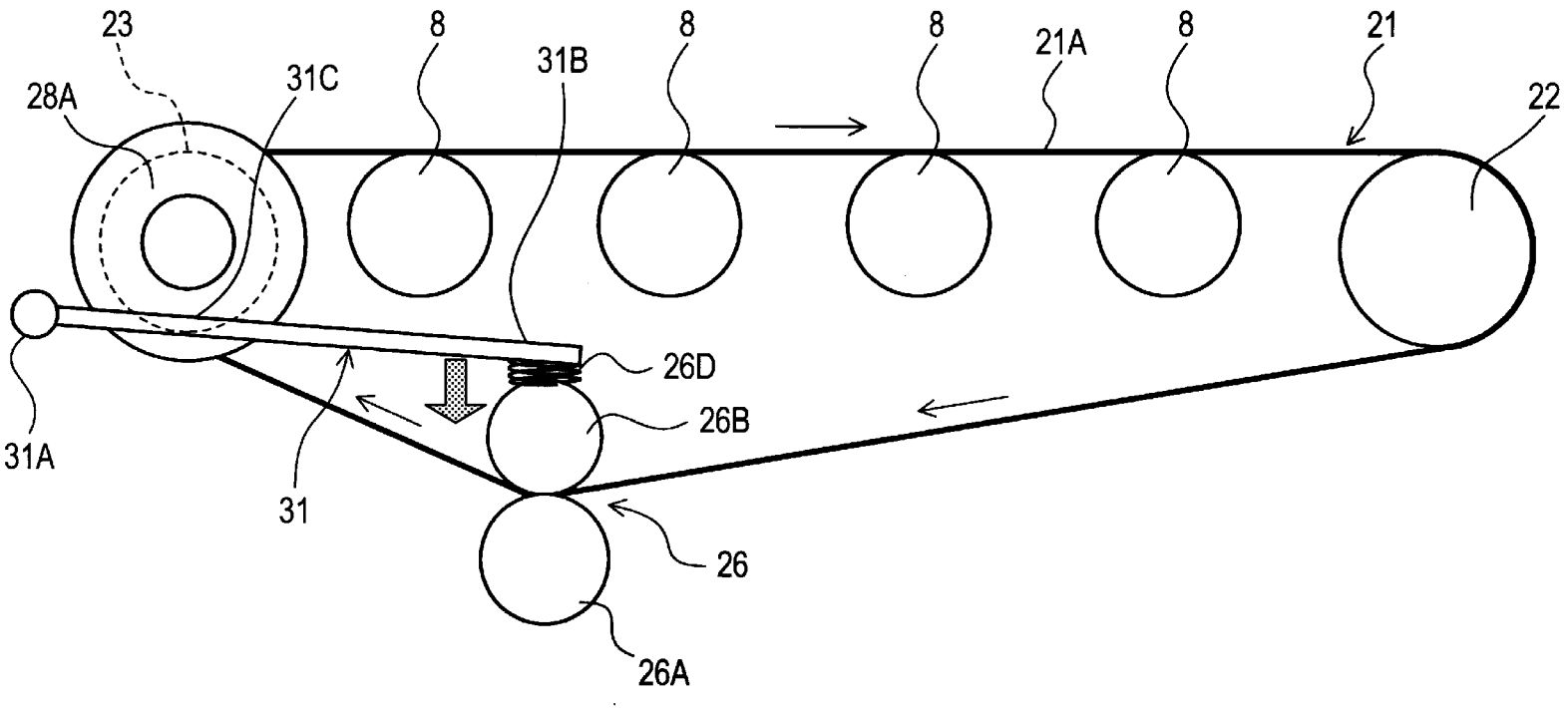
FIG. 7 is a side view of the belt unit of the image forming device according to the first embodiment.

Therefore, as shown in FIG. 7, when the transfer belt 21 moves obliquely to the collar 27 side, one side of the backup roller 26B on which the collar 27 is located is pressed by the press arm 31. Therefore, in this embodiment, oblique motion of the transfer belt 21 can be prevented as described below.

According to the embodiment, when the transfer belt 21 moves obliquely, the collar 27 is pressed by the transfer belt 21, and thereby one axial end of the backup roller 26 on which the collar 27 is provided is pressed by the transfer belt 21 via the press arm 31. As a result, the following advantages (I) and/or (II) can be obtained, and thereby it becomes possible to prevent the oblique motion of the transfer belt 21 by mechanical control.

(I) That is, a belt provided to extend between rollers has a property that, when unevenness of the tension is caused in the width direction of the belt, the belt moves obliquely from a side on which a larger tension is caused to a side on which a smaller tension is caused. In other words, there is a possibility that, when the collar 27 is pressed by the belt 21, the tension caused on the collar 27 side of the belt 21 is smaller than the tension caused on the opposite side of the collar 27 on the belt 21. By contrast, according to the embodiment, when the collar 27 moves by being pressed by the belt 21, one end of the backup roller 26B on which the collar 27 is provided is pressed. Therefore, it becomes possible to increase the tension of the belt 21 on the side on which the collar 27 is provided, and thereby it becomes possible to prevent progress of the oblique motion.

(II) Furthermore, a belt provided to extend between rollers has a property that when the roller is inclined with respect to the stretched surface, the belt obliquely moves from a side on which a moving amount of the belt from the stretched surface is larger to a side on which the moving amount of the belt from the stretched surface is smaller. The stretched surface of the belt means a portion on the belt which has a flat shape by being stretched by the rollers and does not contact the rollers. Specifically, the stretched surface means a flat portion of the belt caused between the rollers which are adjacent to each other in the rotational direction of the belt 21. The moving amount from the stretched surface means a difference between a stretched surface (an ideal stretched surface) defined when the axial lines of the two rollers become parallel with each other and an actual stretched surface. Therefore, when the actual stretched surface matches with the ideal stretched surface (i.e., the moving amount is zero) and the tension of the belt is uniform in the width direction, the oblique motion hardly occurs.

There is a possibility that, when the collar 27 is pressed by the belt 21, the moving amount from the stretched surface caused on the collar 27 side is smaller than the moving amount from the stretched surface caused on the opposite side of the collar 27. In this point of view, according to the embodiment, when the collar 27 moves while being pressed by the belt 21, one side of the backup roller 26B on which the collar 27 is provided is pressed. Therefore, the moving amount from the stretched surface caused on the collar 27 side can be increased. Since the moving amount from the stretched surface can be uniformised, it is possible to prevent progress of the oblique motion.

Each of FIGS. 4 and 7 is illustrated in an exaggerated form such that the transfer belt 21 is deformed largely by the backup roller 26B. However, an actual deforming amount of the transfer belt 21 is such that it cannot be visually recognized.

The feature of the embodiment is that the movable part 31C is provided between the swinging center 31A and the acting part 31B of the press arm 31. As a result, the distance between the swinging center 31A and the acting part 31B becomes larger than the distance between the singing center 31A and the movable part 31C. Therefore, it becomes possible to move the acting part 31B in such a manner that the moving amount of the movable part 31C is enlarged.

In this embodiment, the oblique motion of the transfer belt 21 is prevented by using the existing backup roller 26B. Therefore, there is no need to newly provide a roller for preventing the oblique motion. As a result, it becomes possible to suppress increase of manufacturing costs for the image forming device.

In this embodiment, the backup roller 26B is pressed by the press arm 31 via the elastic member 26D which is elastically deformable. As a result, it becomes possible to achieve the above described advantages (I) and (II) while absorbing size variations and assembling dimensions of the collar 27, the press arm 31 and the backup roller 26B.

The feature of the embodiment is that the guide rib 21B is provided only on the side, in the width direction, on which the collar 27 is provided. As a result, the oblique motion of the transfer belt 21 to the opposite side of the collar 27 can be prevented by the guide rib 21B.

That is, when the transfer belt 21 moves obliquely to the opposite side of the collar 27, the guide rib 21B contacts the side wall S2 of the guide groove 27B, and a force having a direction departing from the frame 24 acts on the collar 27.

However, the collar 27 is restricted not to largely move in the axial direction with respect to the roller shaft 23B, and the roller shaft 23B is restricted not to largely move in the axial direction with respect to the frame 24. Therefore, the transfer belt 21 is restricted not to further obliquely move.

Therefore, even when an oblique motion occurs in any direction, it is possible to prevent such oblique motion, by providing the collar 27 and the press arm 31 on only one side in the axial direction and by providing the guide rib 21B only on the same side as that of the collar 27.

Incidentally, if the guide rib 21B and the guide groove 27B are provided only on the opposite side end with respect to the collar 27 in the axial direction, the guide rib 21B positioned at the front end of the oblique motion direction receives an oblique motion force when the transfer belt 21 obliquely moves to the opposite side of the collar 27. In this case, a compressive force acts on the transfer belt 21 in the width direction, and therefore the possibility that the transfer belt 21 deforms to be buckled in the width direction is high.

By contrast, according to the embodiment, the guide rib 21B is provided on the side of the transfer belt 21 on which the collar 27 is provided. Therefore, regarding the oblique motion force caused when the transfer belt 21 moves obliquely to the opposite side of the collar 27, the guide rib 21B located on a back end of the oblique motion direction receives the oblique motion force. As a result, a drawing force in the width direction acts on the transfer belt 21, and therefore it becomes possible to prevent the transfer belt 21 from being deformed to be buckled in the width direction.

In this embodiment, the outer diameter D1 of the cam part 28 is smaller than the diameter D2 of the roller part 23A and larger than the inner diameter D3 of the guide rib 21B. As a result, it becomes possible to prevent occurrence of a phenomenon that, when the transfer belt 21 moves obliquely to the collar 27 side, only a side face of the guide rib 21B contacts the side wall S1 of the collar 27, and the belt body 21C is prevented from contacting the side wall S1.

Second Embodiment

Figure 8:
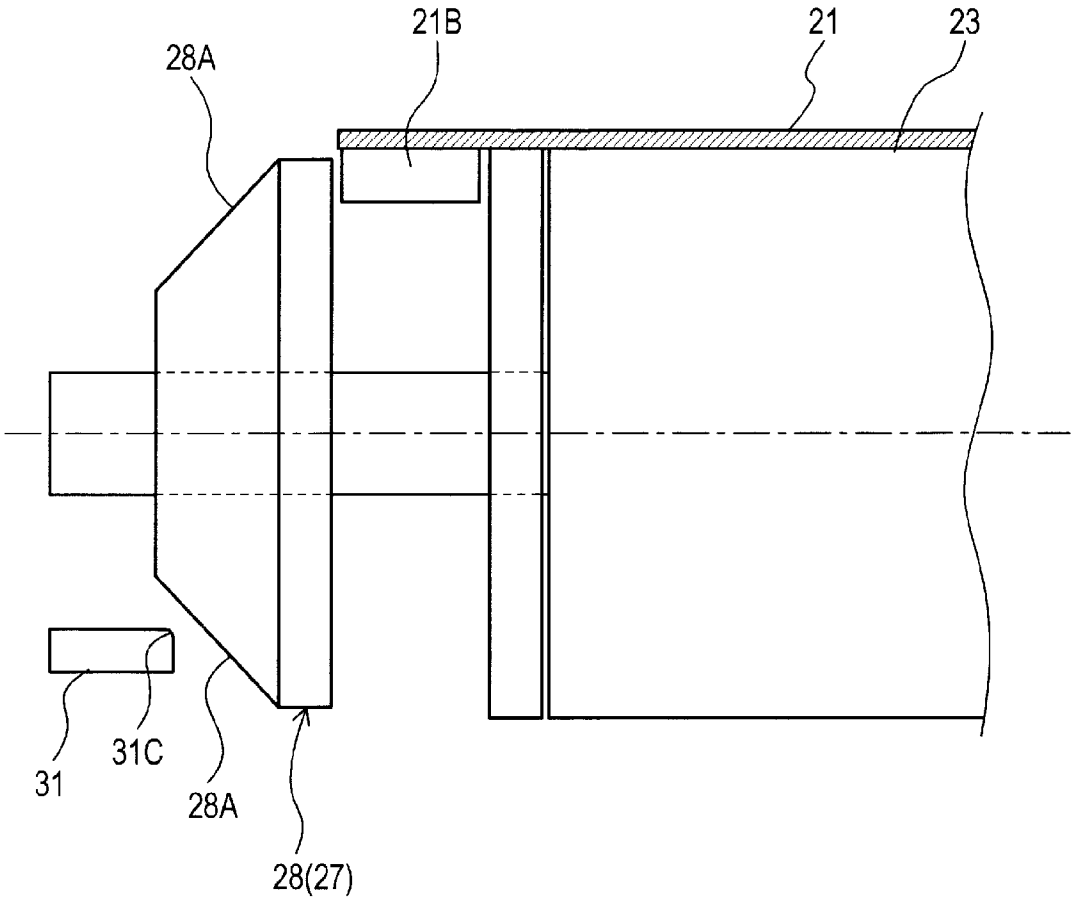
FIG. 8 is an enlarged cross section around a collar of an image forming device according to a second embodiment.

In the above described first embodiment, the guide groove 27B is formed on the collar 27. By contrast, in the second embodiment, the guide groove 27B is not formed and an end face in the axial direction of the roller part 23A is used as the side wall S2 as shown in FIG. 8.

Third Embodiment

Figure 9:
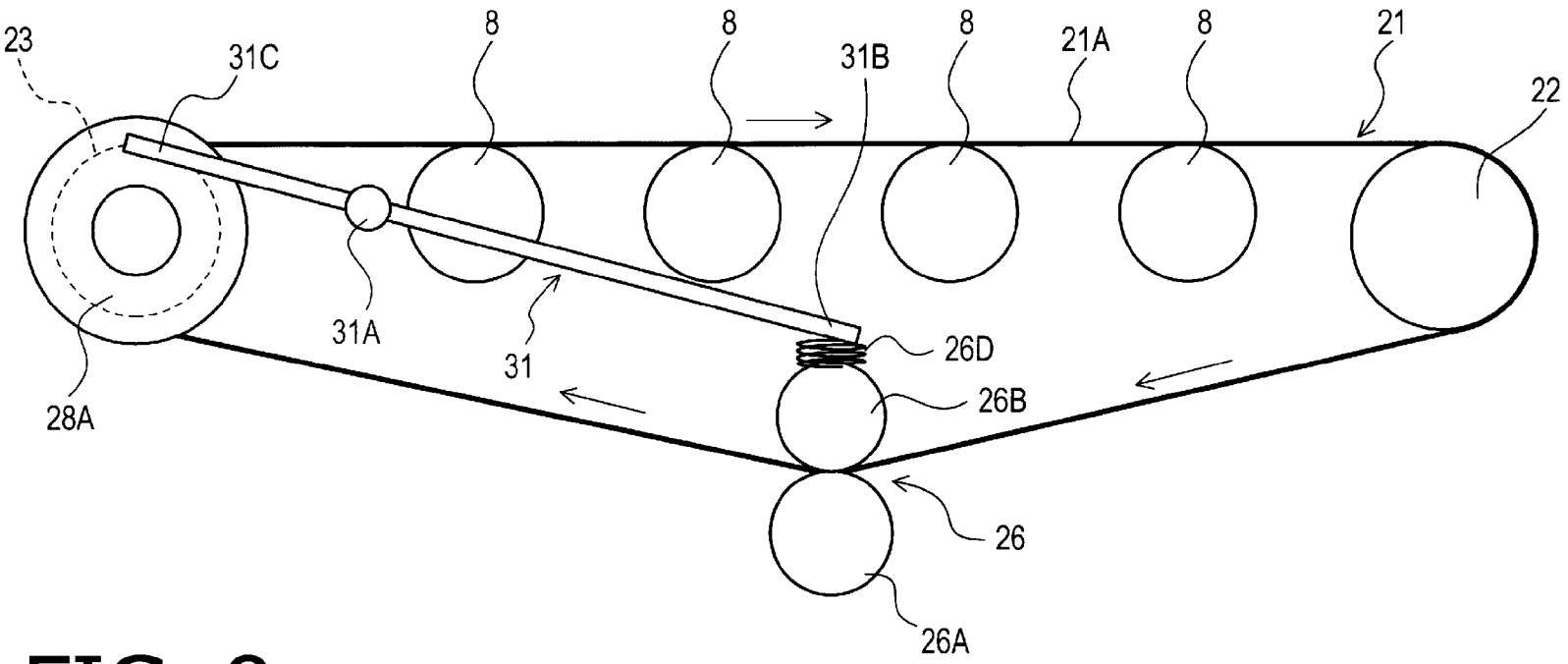
FIG. 9 is a side view of a belt unit of an image forming device according to a third embodiment.

In the above described embodiments, the movable part 31C is provided between the swinging center 31C and the acting part 31B. By contrast, in the third embodiment, the swinging center 31A is provided between the movable part 31C and the acting part 31B as shown in FIG. 9.

In this embodiment, a slidable contact part between the movable part 31C and the slanting surface 28A is located on the opposite side of the slidable contact part of the above described in the first embodiment, with respect to the center of the collar 27, i.e., the rotation center line L1.

Other Embodiments

In the above described embodiments, the guide rib 21B is provided. However, the present invention is not limited to such a configuration. For example, the guide rib 21B may not be provided, and in this case the collar 27 and the cam part 28 may be provided on both ends of the axial direction.

In the above described embodiment, the collar 27 is integrally formed with the cam part 28. The present invention is not limited to such a configuration. For example, the collar 27 may be provided separately from the cam part 28.

In the above described embodiments, the guide rib 21B is provided on the side in the width direction on which the collar 27 is provided. However, the present invention is not limited to such a configuration. For example, the guide rib 21B may be provided only on the opposite side in the width direction of the transfer belt 21.

In the above described embodiments, the cam part 28, i.e., the slanting surface 28A, is provided on the collar 27, and the movable part 31C is provided on the press arm 31. However, the present invention is not limited to such a configuration. For example, the slanting surface 28A may be provided on the press arm 31, and the movable part 31C may be provided on the collar 27.

In the above described embodiment, the oblique motion of the transfer belt 21 is prevented by using the backup roller 26B. However, the present invention is not limited to such a configuration. For example, a roller for preventing the oblique motion may be newly provided.

In the above described embodiments, the collar 27 is provided on the driven roller 23. However, the present invention is not limited to such a configuration. For example, the collar 27 may be provided on the drive roller 22.

In the above described embodiments, the present invention is applied to a tandem type image forming device. However, the present invention is not limited to such a configuration. For example, the present invention may be applied to an intermediate transfer type image forming device in which a developer image is transferred to a sheet-like medium after transferring the developer image to the transfer belt 21, or an inkjet type image forming device.

What is claimed is:

1. An image forming device, comprising:

an image formation unit;

first, second and third rollers arranged such that axial directions of the first, second and third rollers are substantially parallel with each other, and such that a distance between the first roller and the third roller is greater than both a distance between the first roller and the second roller and a distance between the third roller and the second roller;

an endless belt extending around the first, second and third rollers;

a collar provided at an axial end of the first roller, configured to move along the axial direction of the first roller when pressed by the endless belt as the endless belt moves obliquely;

a press arm that extends from the axial end of the first roller to an axial end of the second roller, configured to swing about a swing center and to displace the axial end of the second roller in a direction perpendicular to an axis of the second roller, wherein the axial end of the first roller is on a same side of the endless belt as the axial end of the second roller; and an oblique motion force conversion unit that includes a cam on which a slanting surface slanted with respect to the axial direction of the first roller is formed and a movable part which slidably contacts the slanting surface, configured to convert an oblique motion force of the endless belt to a force which causes the press arm to swing about the swing center, wherein when the collar is pressed by the endless belt, the axial end of the second roller displaces in a direction that increases tension of the belt, generating tension differences within the endless belt in a width direction, which causes the endless belt to move from a higher tension side in the width direction to a lower tension side in the width direction, and wherein the slanting surface is slanted such that an end of the slanting surface farthest from an end of the endless belt in the width direction is closer to an axis of the first roller than an end of the slanting surface closest to the end of the endless belt in the width direction.

2. The image forming device according to claim 1, wherein:

the cam is provided on the collar; and the movable part is provided on the press arm.

3. The image forming device according to claim 2, wherein:

the press arm is formed to extend in a direction perpendicular to the axial direction;

the swing center of the press arm is located on an end of the press arm;

an acting part of the press arm is located on an opposite end of the press arm than the end of the press arm where the swing center is located; and the movable part is located between the swing center and the acting part of the press arm.

4. The image forming device according to claim 1, wherein the image formation unit is arranged to face a stretched surface of the endless belt, wherein the stretched surface is stretched by the first roller and the third roller.

5. The image forming device according to claim 4, wherein:

the third roller is a drive roller which rotates the endless belt;

the first roller is a driven roller which is driven to rotate together with the endless belt;

a belt cleaner which removes adhered substances adhered to the endless belt is arranged on an opposite surface of the endless belt than a surface of the endless belt which the second roller is arranged; and the second roller is a backup roller which presses the endless belt against the belt cleaner.

6. The image forming device according to claim 1, wherein the second roller is pressed by the press arm via an elastic member which is elastically deformable.

7. The image forming device according to claim 1, wherein, on an inner surface of the endless belt on a side of the endless belt in the width direction which is closest to the collar, a guide rib which restricts oblique motion of the endless belt in the width direction and away from the collar is formed to protrude inward and to extend along a rotational direction of the endless belt.

8. The image forming device according to claim 1, wherein the image formation unit is an electrophotographic type image formation unit in which a plurality of photosensitive drums are arranged in series in a rotational direction of the endless belt.

9. An image forming device, comprising:

an image formation unit;

first, second and third rollers arranged such that axial directions of the first, second and third rollers are substantially parallel with each other, and such that a distance between the first roller and the third roller is greater than both a distance between the first roller and the second roller and a distance between the third roller and the second roller;

an endless belt extending around the first, second and third rollers;

a collar provided at an axial end of the first roller, configured to move along the axial direction of the first roller when pressed by the endless belt as the endless belt moves obliquely;

a press arm that extends from the axial end of the first roller to an axial end of the second roller, configured to swing about a swing center and to displace the axial end of the second roller in a direction perpendicular to an axis of the second roller, wherein the axial end of the first roller is on a same side of the endless belt as the axial end of the second roller; and an oblique motion force conversion unit that includes a cam on which a slanting surface slanted with respect to the axial direction of the first roller is formed and a movable part which slidably contacts the slanting surface, configured to convert an oblique motion force of the endless belt to a force which causes the press arm to swing about the swing center, wherein when the collar is pressed by the endless belt, the axial end of the second roller displaces in a direction that increases tension of the belt, generating tension differences within the endless belt in a width direction, which causes the endless belt to move from a higher tension side in the width direction to a lower tension side in the width direction, wherein the slanting surface is slanted such that an end of the slanting surface farthest from an end of the endless belt in the width direction is closer to an axis of the first roller than an end of the slanting surface closest to the end of the endless belt in the width direction, and wherein the axial end of the second roller is displaced by the press arm via an elastic member.

10. An image forming device, comprising:

an image formation unit;

first, second and third rollers arranged such that axial directions of the first, second and third rollers are substantially parallel with each other, and such that a distance between the first roller and the third roller is greater than both a distance between the first roller and the second roller and a distance between the third roller and the second roller;

an endless belt extending around the first, second and third rollers;

a collar provided at an axial end of the first roller, configured to move along the axial direction of the first roller when pressed by the endless belt as the endless belt moves obliquely;

a cam configured to move in the axial direction of the first roller as the collar moves in the axial direction of the first roller;

a movable part configured to contact the cam and to recede from an axis of the first roller as the cam moves in the axial direction;

a slanting surface formed on at least one of the cam and the movable part, the slanting surface configured such that an end of the slanting surface farthest from an end of the endless belt in a width direction is closer to the axis of the first roller than an end of the slanting surface closest to the end of the endless belt in the width direction; and a press arm that extends from the axial end of the first roller to an axial end of the second roller, configured to swing about a swing center and to displace the axial end of the second roller in a direction perpendicular to an axis of the second roller, wherein the axial end of the first roller is on a same side of the endless belt as the axial end of the second roller, wherein when the collar is pressed by the endless belt, the axial end of the second roller displaces in a direction that increases tension of the belt, generating tension differences within the endless belt in the width direction, which causes the endless belt to move from a higher tension side in the width direction to a lower tension side in the width direction.

11. The image forming device according to claim 10, wherein the cam and the collar are integrally formed.

12. The image forming device according to claim 10, wherein the slanting surface is provided on the cam.

13. The image forming device according to claim 10, wherein the movable part is provided on the press arm.

14. The image forming device according to claim 10, wherein the swing center is positioned closer to the first roller than to the second roller.

15. The image forming device according to claim 14, wherein:

the swing center is located on an end of the press arm;

the axial end of the second roller is located on an opposite end of the press arm than the end of the press arm where the swing center is located; and the axial end of the first roller is located between the swing center and the axial end of the second roller.

16. The image forming device according to claim 10, wherein the second roller is pressed by the press arm via an elastic member.

17. The image forming device according to claim 10, wherein the second roller is positioned closer to the first roller than to the third roller, and wherein the axis of the second roller is shifted from a plane defined by joining the axis of the first roller and an axis of the third roller.

18. The image forming device according to claim 17, wherein the second roller is pressed in a direction that recedes from the first roller and the third roller.

* * * * *